United States Patent [19]

Pöhlmann

[11] Patent Number: 4,979,472

[45] Date of Patent: Dec. 25, 1990

[54] INTERNAL COMBUSTION ENGINE HAVING A HERMETICALLY SEALED HEAT EXCHANGER TUBE SYSTEM

[75] Inventor: Erich Pöhlmann, Kulmbach, Fed. Rep. of Germany

[73] Assignee: Poehlmann Anwendungstechnik GmbH & Co. KG, Kulmbach, Fed. Rep. of Germany

[21] Appl. No.: 301,056

[22] Filed: Jan. 25, 1989

[30] Foreign Application Priority Data

Feb. 1, 1988 [DE] Fed. Rep. of Germany ..... 3805131

[51] Int. Cl.[5] ..... F01P 9/02

[52] U.S. Cl. ..... 123/41.21; 123/41.24; 165/104.21

[58] Field of Search ..... 123/41.2, 41.21, 41.24, 123/41.25, 41.26, 41.51, 41.52; 165/51, 104.21, 104.26

[56] References Cited

U.S. PATENT DOCUMENTS

| | | | |
|---|---|---|---|
| 1,226,180 | 5/1917 | Bouton | 123/41.26 |
| 1,663,016 | 3/1928 | Manning | 123/41.21 |
| 2,926,641 | 3/1960 | Tacchella et al. | 123/41.21 |
| 3,731,660 | 5/1973 | Leffert | 123/41.42 |
| 3,838,668 | 10/1974 | Hays et al. | 123/41.26 |

FOREIGN PATENT DOCUMENTS

| | | | |
|---|---|---|---|
| 110966 | 10/1928 | Fed. Rep. of Germany . | |
| 2654034 | 6/1977 | Fed. Rep. of Germany . | |
| 8709826 | 9/1987 | Fed. Rep. of Germany . | |
| 260376 | 11/1926 | United Kingdom | 123/41.24 |

*Primary Examiner*—Noah P. Kamen

*Attorney, Agent, or Firm*—Sixbey, Friedman, Leedom & Ferguson

[57] ABSTRACT

Disclosed is a radiator located above an engine forming a hermetically sealed heat exchanger tube system. The engine can quickly heat up. The coolant circulates by an evaporitive - condensing cycle.

6 Claims, 1 Drawing Sheet

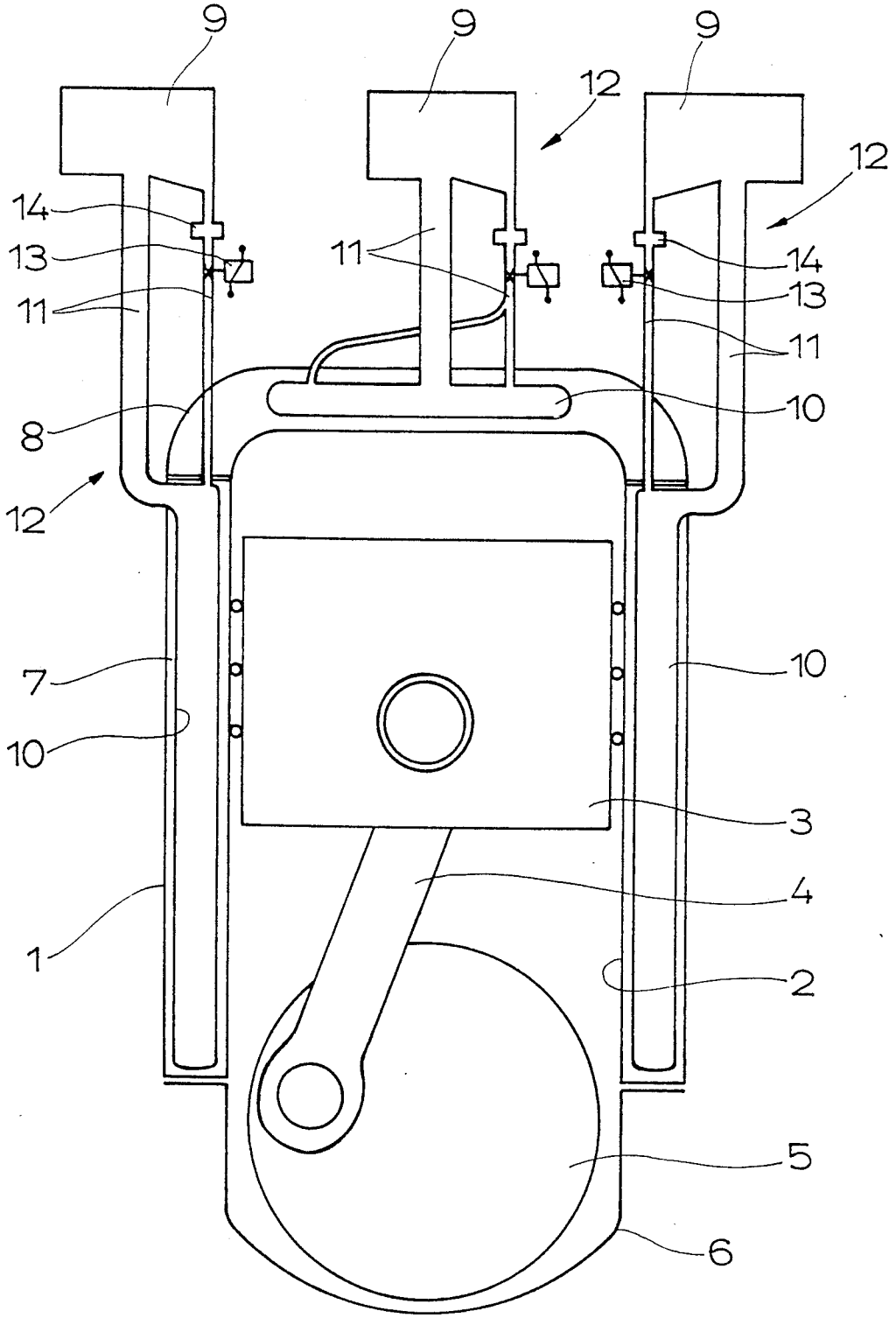
9
9
9
12
12
14
13
11
11
14
13
11
10
8
12
7
10
10
3
4
1
2
5
6

INTERNAL COMBUSTION ENGINE HAVING A HERMETICALLY SEALED HEAT EXCHANGER TUBE SYSTEM

BACKGROUND OF THE INVENTION

The invention relates to an internal combustion engine of the type wherein heat produced by the engine is transferred to a radiator by the circulation of coolant from coolant lines and spaces in the engine to the radiator via a pair of coolant transport lines.

Internal combustion engines have always been air- or water-cooled, today mainly water-cooled.

With air-cooling, the heat that is genrated during combustion and transferred to the cylinder head and the cylinder block of the engine block is eliminated by blowing cool air on these parts. In doing so, the air heats up correspondingly. The surface of the engine parts to be cooled is enlarged by fins to facilitate heat extraction. An air-cooled interanl combustion engine reaches its operating temperature relatively quickly, but this temperature is higher than the operating temperature of water-cooled internal combustion engines and the cooling is also more uneven than with water.

With a water-cooled internal combustion engine, the cylinder head and the cylinder block are constructed with double walls, and in the spaces so created, a water-/antifreeze mixture flows as a coolant from the bottom upward. The heated coolant leaves the engine block at the highest point and flows through an air radiator in which the coolant flows from the top downward through a large number of channels placed parallel to each other. The coolant cooled in the radiator is again fed to the engine block at the lowest point and distributed throughout the system of coolant lines and spaces in the engine block. So that a cold internal combustion engine can reach its operating termperature quickly, the system of coolant lines and spaces can be closed in an inner loop within which only a small amount of coolant circulates until the operating temperature of the engine block has been reached, and then, a thermostat switch opens a large loop to the radiator. Despite this, because a water-cooled system contains a relatively large amount of coolant with a correspondingly high heat absorption capacity, a water-cooled internal combustion engine takes a relatively long time for the operating temperature to be reached. During this warm-up phase, the wear to which the internal combustion engine is sugjected is considerable, and until the operating temperature is reached, there are superproportionally high amounts of pollutants in the exhaust gas. Futher, the structual expense for conveying the water with a pump, thermostat, hose lines, radiator core, etc., is not unsubstantial. Finally, with the usual coolant of a water/antifreeze mixture, reaching temperatures over 100° C. is connected with quite a considerable additional expense, since then the cooling system must be made pressure resistant. Operating temperatures of the internal combustion engine over 100° C., which would generally be suitable for efficiency, can thus hardly be reached with water-cooled internal combustion engines.

SUMMARY OF THE INVENTION

A primary object of the present invention is to provide an internal combustion engine with a cooling system designed to make possible a quick heat-up of the engine block and to attain a high efficiency for the internal combustion engine overall. More particularly, to attain the foregoing object via a fundamental different system design than has been used up to now, and as described above.

The objects outlined above are achieved in accordance with the present invention by adapting the cooling system of an internal combustion engine of the type having a radiator, coolant lines and spaces in the engine and interconnecting coolant transport lines to the heat exchanger tube principle. A heat exchanger tube is a system filled with a small amount of liquid coolant, for example water or a refrigerant, and further, is a partially evacuated, hermetically sealed system, in which the liquid coolant evaporates at an end of the tube facing the heat source, rises as steam to the end facing the heat sink, condenses on the end facing the heat sink flows back again as condensate, i.e., liquid, to the end facing the heat source. The efficiency of this heat transport system is extremely high, since the heat absorption on the end of the heat exchanger tube facing the heat source occurs by a change of state of the coolant.

In the internal combustion engine according to the invention, attention must be paid to ensure that the cooling system designed in the manner of a heat exchanger tube is made to rise from the heat source to the heat sink and that the condensate flowing back is distributed as evenly as possible in the system of coolant lines and spaces, to guarantee an even cooling.

Because of the small amount of coolant, an internal combustion engine cooled according to the invention reaches its operating temperature very quickly. Furthermore, overall, a higher operating temperature for the internal combustion engine is possible, which results in improved efficiency, lessened pollutant emissions and lowered overall structural expenses, especially since a coolant pump is not necessary.

Details of a heat exchanger tube system, per se, are disclosed in German Gebrauchsmuster No. 87 09 826.

These and further objects, features and advantages of the present invention will become more obvious from the following description when taken in connection with the accompanying drawing which shows, for purposes of illustration only, a single embodiment in accordance with the present invention.

BRIEF DESCRIPTION OF THE DRAWING

The sole FIGURE of the drawing diagrammatically shows a section through an interanl combustion engine with a cooling system according to the invention.

DETAILED DESCRIPTION OF THE PREFERRED EMBODIMENT

As apparent from the drawing, an engine block 1 is formed with a cylinder 2 in it. A piston 3 reciprocates in cylinder 2, and the piston 3 is linked to a connecting rod 4 mounted on a crankshaft 5. An oil pan 6 is also provided. Engine block 1 is divided into cylinder block 7 and cylinder head 8. Also belonging to the internal combustion engine are a radiator 9, representing a heat sink, a system of coolant lines and spaces 10 formed in engine block 1 and several transport lines 11 connecting the system of coolant lines and spaces 10 with radiator 9.

According to the invention, radiator 9 is placed above the system of coolant lines and spaces 10, and the coolant lines and spaces 10 together with the transport lines 11, are made to rise from the lowest point of the system to radiator 9. Furthermore, radiator 9, the system of coolant lines and spaces 10 and transport lines 11 are designed as a hermetically sealed heat exchanger tube system 12, which is filled with only a small amount (relative to the capacity/volume of the system) of liquid coolant, in particular water, and from which air is partially evacuated.

While only a single cylinder of the internal combustion engine is represented in the drawing, it should be appreciated that, as is conventional, the engine block 1 may have multiple cylinder areas. Thus, each cylinder area in engine block 1, in accordance with the invention, has, preferably, several separate heat exchanger tube systems 12, in particular a lateral heat exchanger tube system 12 at each side, and a third, middle heat exchanger tube system 12. In the embodiment represented here, both lateral heat exchanger tube systems 12 are associated with the lateral side walls of cylinder block 7, while the middle heat exchanger tube system 12 is associated with the cylinder head 8. With a multicylinder internal combustion engine, several heat exchanger tube systems 12 could also be provided for each cylinder area, and the radiators 9 of the several heat exchanger tube systems 12 could be incorporated into a single, common radiator core. Such a radiator core could be in the form of an air radiator.

The single drawing shows a preferred system wherein the system of coolant lines and spaces 10 in engie block 1, forms a lower uniform part of heat exchanger tube system 12, and transport lines 11 form a feeding channel allowing only upward-flowing steam and a return channel essentially parallel to it allowing only downward-flowing liquid. Furthermore, radiator 9 incorporates a branch of heat exchanger tube system 12 that connects the feeding channel and the return channel. In the preferred embodiment, the feeding channel is the wider channel, thus the one exhibiting the larger diameter, whereas the return channel is the narrower channel exhibiting a smaller diameter. The branch of heat exchanger tube system 12 that connects the feeding channel and the return channel is run from the highest point of the feeding channel downward to the return channel. Further, the flow cross section of the return channel, compared with the flow cross section of the feeding channel, is especially small in the embodiment represented here.

Suitable, the lower ends of the feeding channel and return channel opening into the systems of coolant lines and spaces 10 are positioned just within the engine block 1.

The heat exchanger tube system 12 of the invention can also be provided with a means by which its heat transport activity can be controlled, and specifically so that the coolant that reaches radiator 9 as steam is kept there after condensation. In order that the steam/liquid flow can be controlled in heat exchanger tube system 12, a control element 13 is provided; in particular, a control element 13 is placed in the return channel. Advantageously, control element 13 is placed relatively near radiator 9 and is designed as a valve, in particular as a control valve. Valve 13 is conncected to an electrical, electromagnetic, or electronic control device. Controlled by a thermostat, control element 13 can then be opened or closed by the control device. By pulsed opening or closing, a relatively sensitive temperature control or temperature regulation can be achieved.

If radiator 9 itself is not suitably configured, it is advisable that a collecting chamber 14 for liquid coolant is made above control element 13. The liquid coolant can collect without a problem above control element 13 in this collecting chamber 14.

Finally, it can be advisable to provide several return channels to each radiator 9, as is shown for the middle heat exchanger tube system 12 in the FIGURE. By using multiple return lines, an even return of the condensate into the system of coolant lines and spaces 10 is achieved.

Very generally, it is advantageous that elements, in particular capillary elements, which facilitate the distribution of the liquid coolant, be provided in the system of coolant lines and spaces 10. This makes it possible to bring the liquid coolant specifically to especially problematic points of the engine block.

Further, for other suggestions as to details of heat exchanger tube system construction, German Gebrauchsmuster No. 87 09 826 is hereby referred to again.

While I have shown and described a single embodiment in accordance with the present invention, it is understood that the same is not limited thereto, but is susceptible of numerous changes and modifications as known to those skilled in the art, and I, therefore, do not wish to be limited to the details shown and described herein, but intend to cover all such changes and modifications as are encompassed by the scope of the appended claims.

I claim:

1. Internal combustion engine with an engine block forming a heat source, a radiator forming a heat sink, a system of coolant lines and spaces in the engine block, and at least two coolant transport lines connecting the system of coolant lines and spaces of the engine block with the radiator, wherein the radiator is placed above the system of coolant lines and spaces, wherein the system of coolant lines and spaces together with the transport lines rise from a lowest point of the overall system to the radiator, wherein the radiator, the system of coolant lines and spaces of the engine block and the coolant transport lines are formed as a partially evacuated, hermetically sealed heat exchanger tube system filled with only a small amount of liquid coolant relative to the volume of the tube system, wherein the system of coolant lines and spaces of the engine block forms a uniform lower part of the heat exchanger tube system, wherein said coolant transport lines comprises a feeding channel allowing only upward-flowing steam and a return channel essentially parallel to the feeding channel that allows only a downward-flowing liquid, wherein said radiator incorporates a branch of the heat exchanger tube system that connects the feeding channel and the return channel, wherein a control means for controlling steam/liquid flow in the heat exchanger tube system is provided, and wherein said control means comprises a control element placed in the return channel.

2. Internal combustion engine according to claim 1, wherein each cylinder area of the engine block has several separate said heat exchanger tube systems associated therewith.

3. Internal combustion engine according to claim 1, wherein the several separate exchanger tube systems comprise a lateral heat exchanger tube system at each side of a cylinder block of the engine block and a third, middle heat exchanger tube system for a cylinder head area of the engine block.

4. Internal combustion engine according to claim 1, wherein the lower ends of the feeding channel and return channel opening into the system to coolant lines and spaces are positioned just within the engine block.

5. Internal combustion engine according to claim 1, wherein a collecting chamber for the liquid coolant is disposed above said control means.

6. Internal combustion engine according to claim 1, wherein more than one said return channel is associated with said radiator.

* * * * *